US007762680B1

(12) United States Patent
Miller et al.

(10) Patent No.: US 7,762,680 B1
(45) Date of Patent: Jul. 27, 2010

(54) SHOE LIGHT ATTACHMENT

(76) Inventors: Brian Miller, 3 Carrie St., Lakeville, MA (US) 02347; Beth Miller, 3 Carrie St., Lakeville, MA (US) 02347

( * ) Notice: Subject to any disclaimer, the term of this patent is extended or adjusted under 35 U.S.C. 154(b) by 298 days.

(21) Appl. No.: 12/011,900

(22) Filed: Jan. 30, 2008

(51) Int. Cl.
*F21V 21/08* (2006.01)

(52) U.S. Cl. ..... 362/103; 362/191; 362/285

(58) Field of Classification Search ..... 362/191, 362/103, 269, 285, 183; 36/136, 137
See application file for complete search history.

(56) References Cited

U.S. PATENT DOCUMENTS

| | | | | |
|---|---|---|---|---|
| 2,671,847 | A * | 3/1954 | Lerch | 362/103 |
| 3,501,144 | A * | 3/1970 | Schmidt | 273/454 |
| 3,992,790 | A | 11/1976 | Frye | |
| 4,004,355 | A | 1/1977 | Koblick | |
| 5,508,899 | A * | 4/1996 | McCormick | 362/103 |
| 5,738,432 | A * | 4/1998 | Okko et al. | 362/103 |
| D442,772 | S | 5/2001 | Dietrich | |
| D453,413 | S | 2/2002 | Tsujino et al. | |
| 2004/0098884 | A1 | 5/2004 | Swan | |

* cited by examiner

*Primary Examiner*—Ali Alavi

(57) ABSTRACT

The shoe light attachment of the present invention includes a harness disposed and fitted to the dimensions of a shoe upper portion. The harness further includes an integrated mounting panel substantially disposed over a shoes laces and having a plurality of receiving sockets formed therein for receiving a light device. The light device includes engagement extensions for selectively moving the light device to varying positions along the mounting panel for proper alignment and orientation of the light device. The harness further includes an oversized switch means to actuate the light device by a foot tap. The harness further includes an elongate ridged member having a first end attached to the mounting panel bottom surface and a second end capable of flexing somewhat stiffly outwardly so as to facilitate the second end being positionable and secured under a shoes laces. The shoe light attachment is secured to a users shoe by the elongate ridged member and straps that extend from the harness around the heel of the shoe.

18 Claims, 9 Drawing Sheets

SHOE LIGHT ATTACHMENT

BACKGROUND OF THE INVENTION

1. Field of the Invention

This invention relates to an attachment for a shoe for providing an adjustable light device actuated by a manually operated switch.

2. Description of the Related Art

Battery operated lighting devices for mounting on the shoes of the wearer are known, however, most devices of the prior art were designed to be integral with the shoe of the wearer. In most cases the battery was placed in the heel and the lighting device placed in the front of the shoe. Other devices used the heel as the mount for both the incandescent light and the battery with the incandescent light beam projecting forward of the heel under the instep.

Other prior art illuminating devices mounted on a shoe were of a decorative nature which were designed to dazzle or fascinate the onlooker. The illuminating device of the present invention is designed to be used as a safety device for runners, joggers, cycles, persons walking at night, ice skaters, roller skaters, and the like.

SUMMARY OF THE INVENTION

It is therefore an object of the present invention to provide an illuminating apparatus which mounts on the shoe of the wearer.

It is a further object of the present invention to provide a shoe mounted lighting device in which the light source is visible to the front of the user and is adjustable.

It is still a further object of the present invention to provide a shoe mounted lighting device incorporating its own battery powered source that may be actuated by tapping a surface mounted foot switch.

It is still another object of the present invention to provide a shoe mounted lighting device which is easily installed on and removed from the shoe of the wearer.

It is still another object of the present invention to provide a shoe mounted lighting device that is stable on the users foot when jogging or exercising.

The shoe light attachment of the present invention comprises a harness disposed and fitted to the dimensions of a shoe upper portion. The harness further comprises an integrated mounting panel substantially disposed over a shoes laces and having a plurality of receiving sockets formed therein for receiving a light device. The light device includes engagement extensions for selectively moving the light device to varying positions along the mounting panel for proper alignment and orientation of the light device. The harness further includes an oversized switch means to actuate the light device by a foot tap. The harness further includes an elongate ridged member having a first end attached to the mounting panel bottom surface and a second end capable of flexing somewhat stiffly outwardly so as to facilitate the second end being positionable and secured under a shoes laces. The shoe light attachment is secured to a users shoe by the elongate ridged member and straps that extend from the harness around the heel of the shoe.

Broader aspects of the invention and devices within the scope of the same will become clearer from a further reading of the specification and claims and a consideration of the drawings. These and other objects which will become apparent upon a reading of the following Specification and Claims.

BRIEF DESCRIPTION OF THE DRAWINGS

The invention is best understood from the following detailed description when read in connection with the accompanying drawings, which illustrate an embodiment of the present invention.

DETAILED DESCRIPTION OF THE INVENTION

Figure 1:
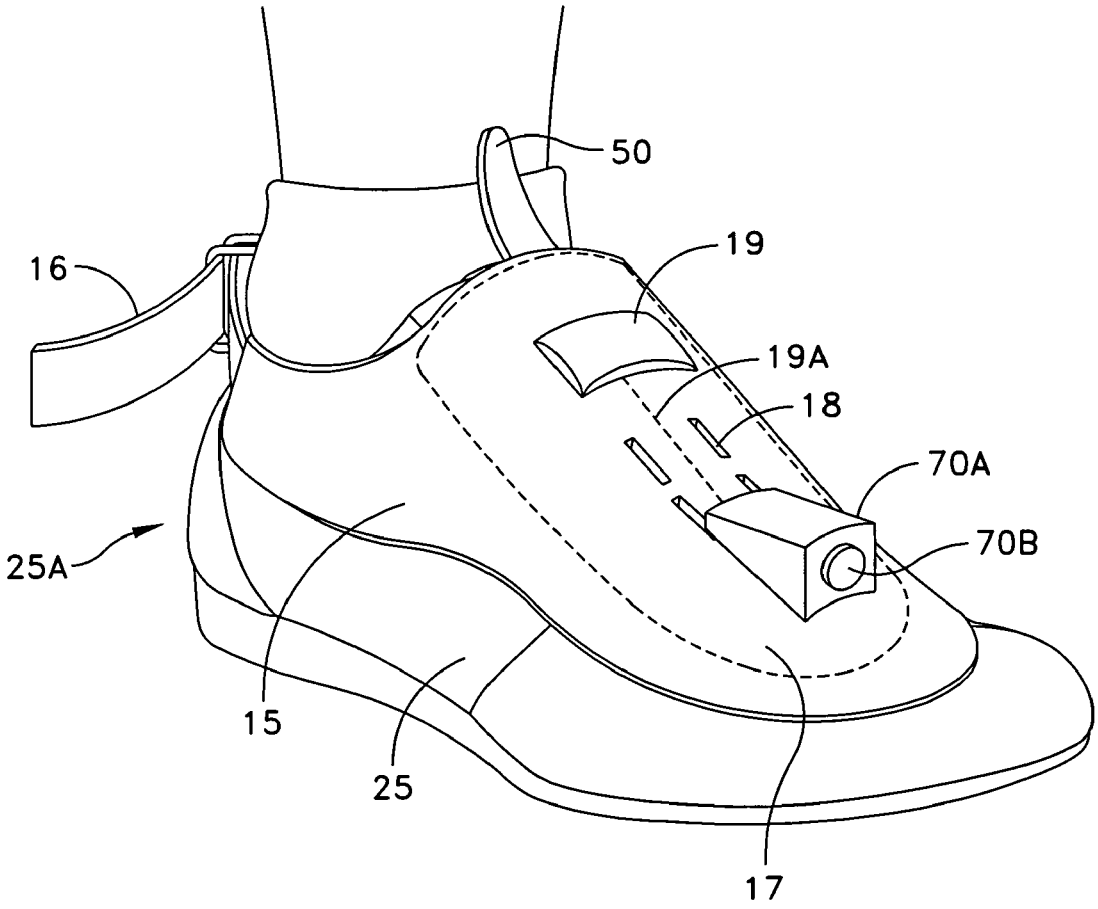
FIG. 1 illustrates a perspective view of the shoe light attachment embodying the principles of the present invention attached to a users shoe.
Figure 2:
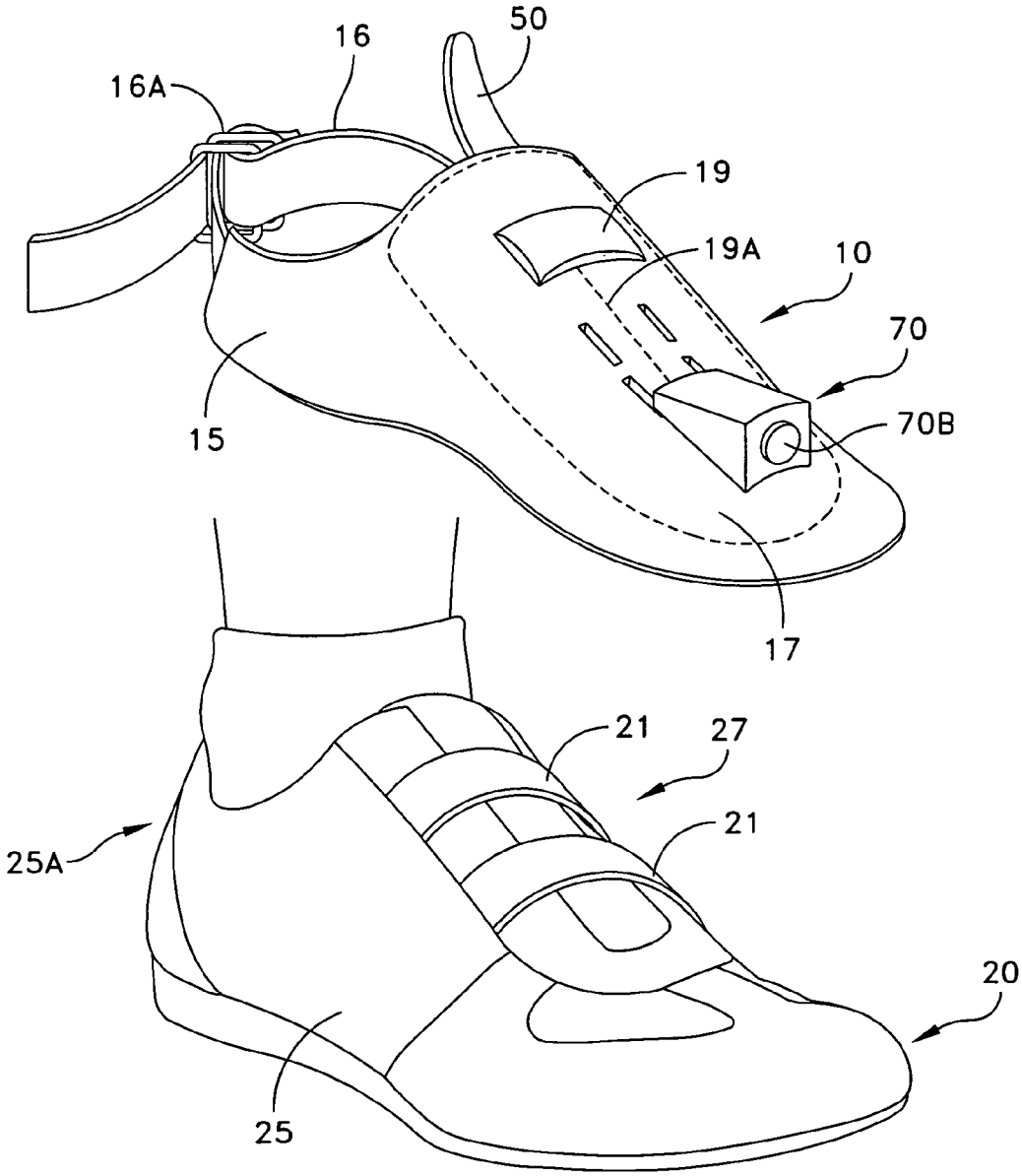
FIG. 2 illustrates a perspective view of the shoe light attachment of FIG. 1 separated from a users shoe.
Figure 3:
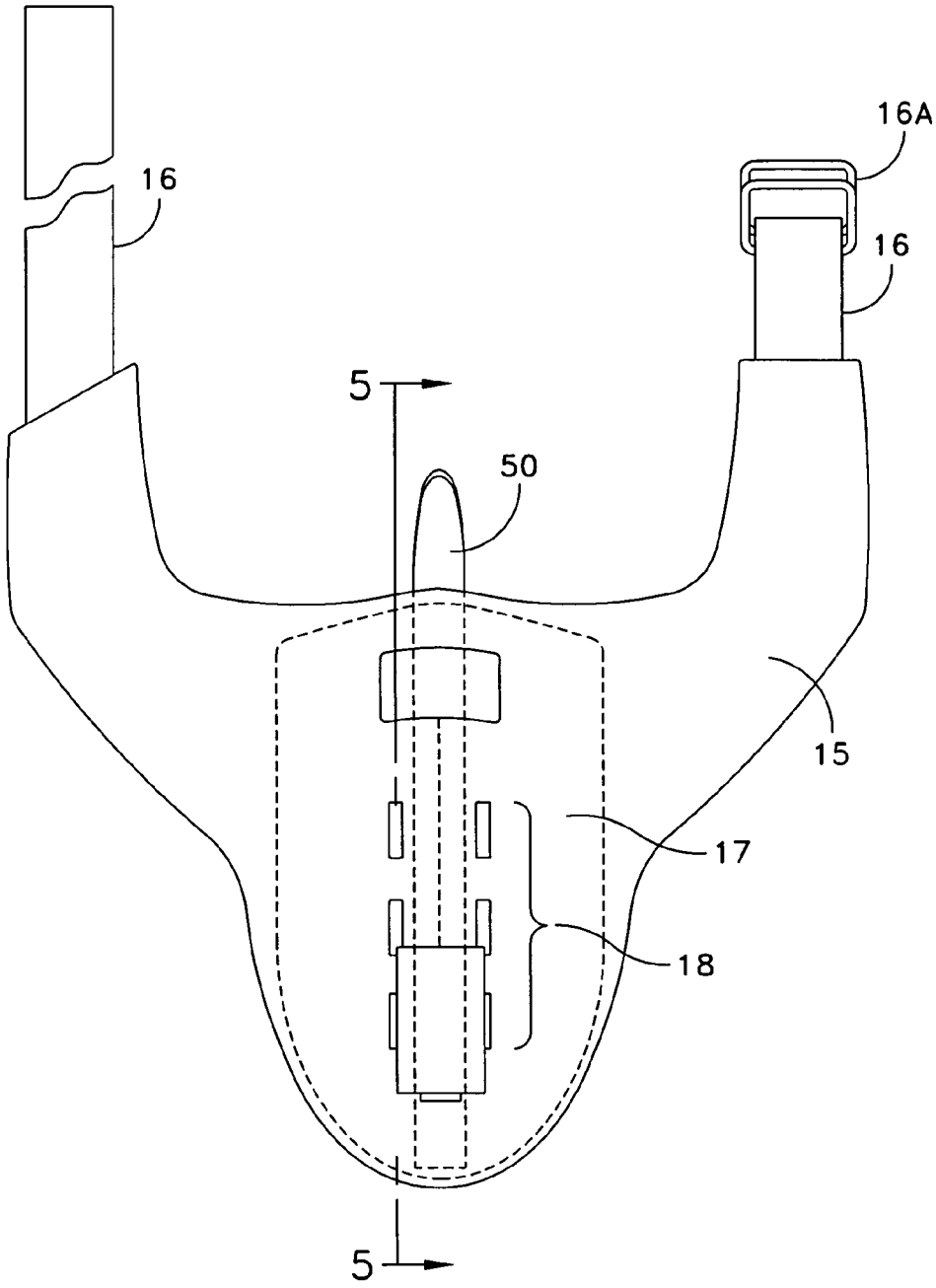
FIG. 3 illustrates a top view of the shoe light attachment of FIG. 1.

Referring to FIG. 1 and FIG. 2 a perspective view of the shoe light attachment 10 embodying the principles of the present invention is disclosed, and shown attached to a shoe 20 in FIG. 1. Referring to FIG. 2, the shoe light attachment 10 includes a harness 15 which is shaped to substantially cover a shoes upper portion 25. The harness 15 further includes straps 16 with buckle means 16A that extend around heel portion 25A of shoe 20. In the preferred embodiment, harness 15 is made from a fabric material that may be flexible and is preferably waterproof.

Referring to FIGS. 3-6, the harness further includes a mounting panel 17 made of a stiff plastic or similar material that is attached beneath the harness 15 and may be attached by gluing or other similar means known in the art. A portion of harness 15 fabric material appears separated from panel 17 in FIGS. 5, 6 and 6A for illustrative purposes only but would be attached normally.

Figure 7:
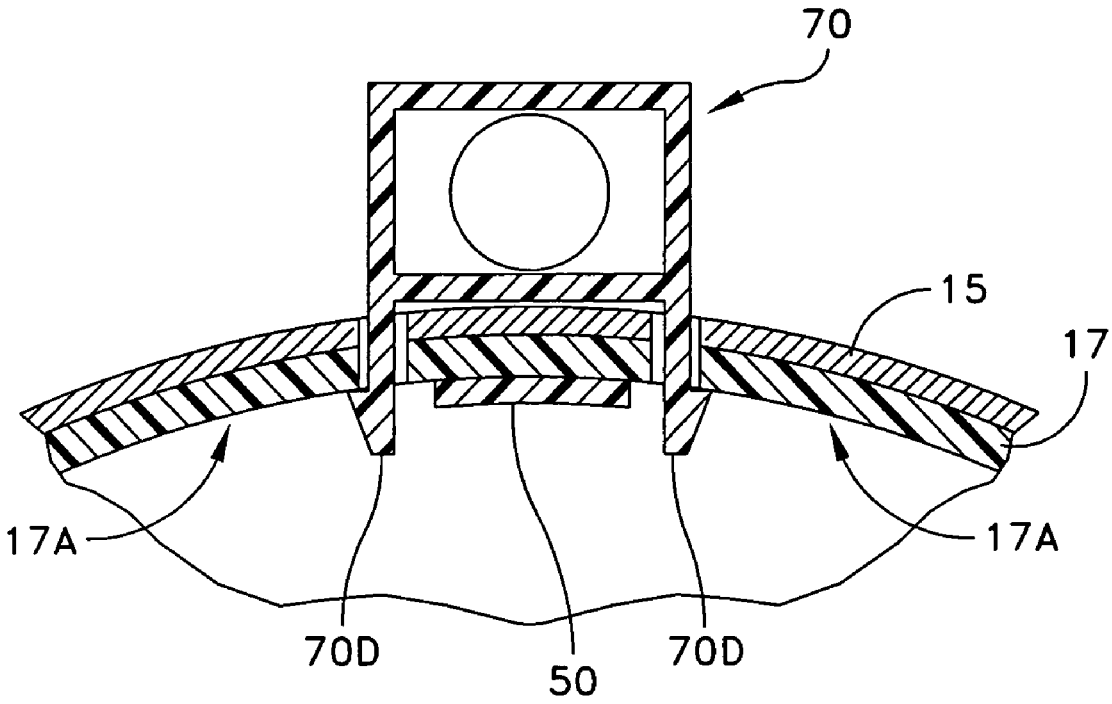
FIG. 7 illustrates a cross-sectional view of the light means attachment to the mounting panel of the shoe light attachment of FIG. 2.
Figure 8:
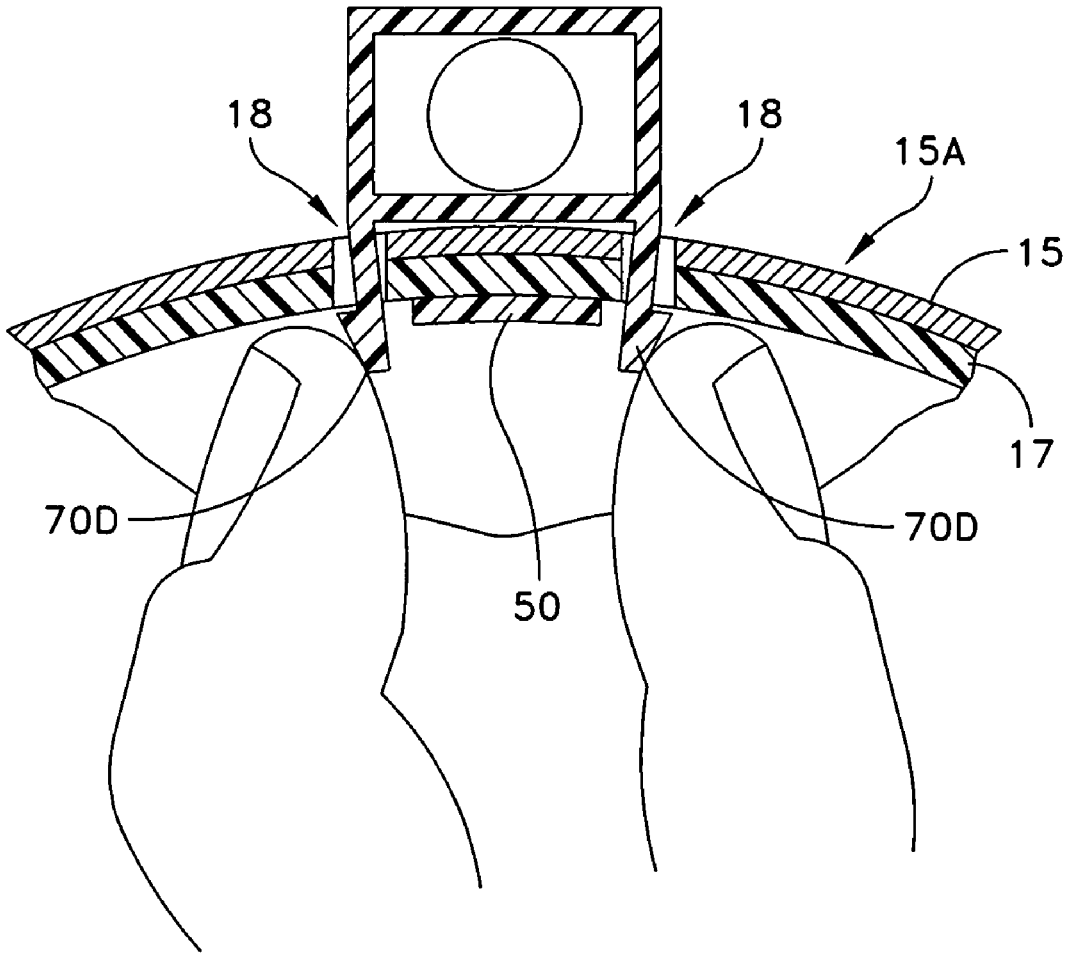
FIG. 8 illustrates a cross-sectional view of the light means attachment to the mounting panel of the shoe light attachment of FIG. 2 and further illustrates the stiffly resilient light means attachment engagement members.
Figure 9:
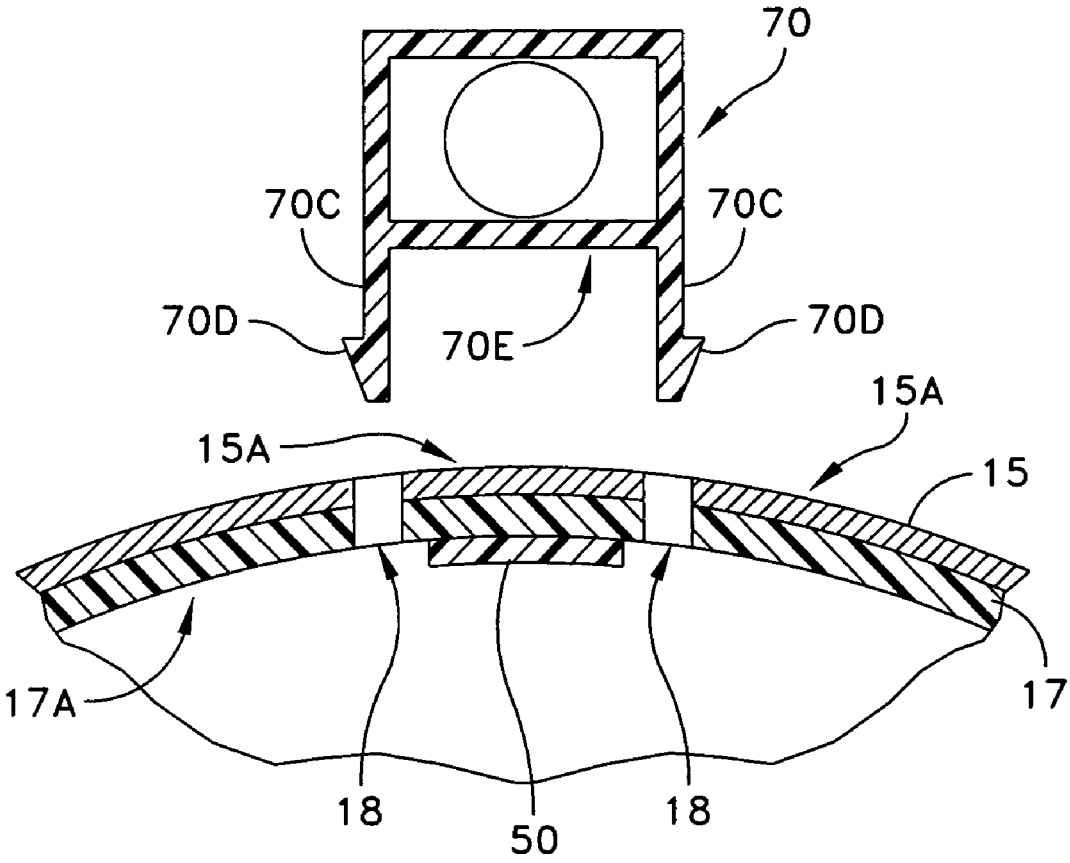
FIG. 9 illustrates a cross-sectional view of the light means detached from the mounting panel of the shoe light attachment of FIG. 2.

The mounting panel 17 is contoured so as to substantially cover the lace portion 27 (FIG. 2) of shoe upper 25. The mounting panel 17 includes a plurality of receiving sockets 18 formed therein. Referring to FIGS. 7-9, receiving sockets 18 are of sufficient depth to allow for secure and stable engagement of light assembly 70 to be mounted therein at a plurality of positions along mounting panel 17.

Figure 6:
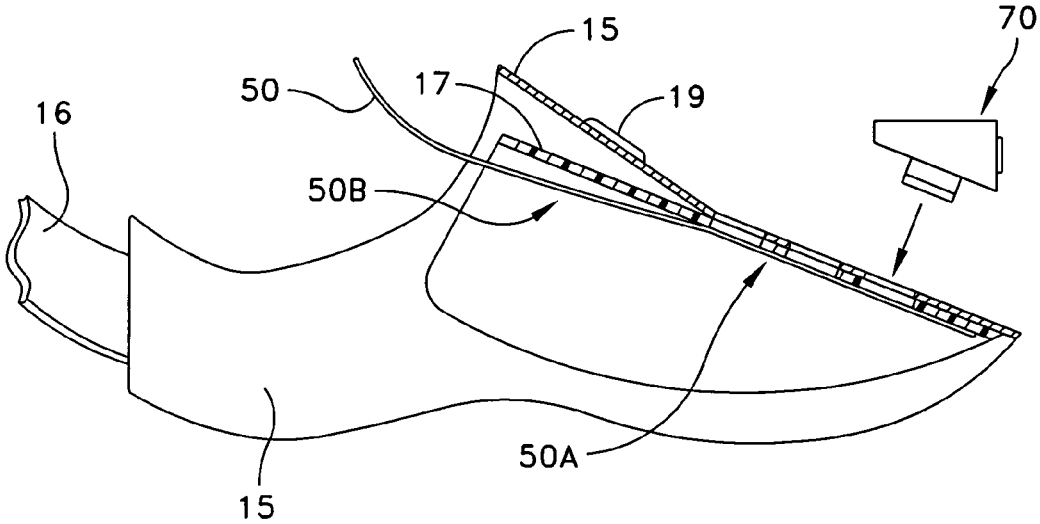
FIG. 6 illustrates a cross-sectional view of the shoe light attachment of FIG. 2 with light means detached.
Figure 6A:
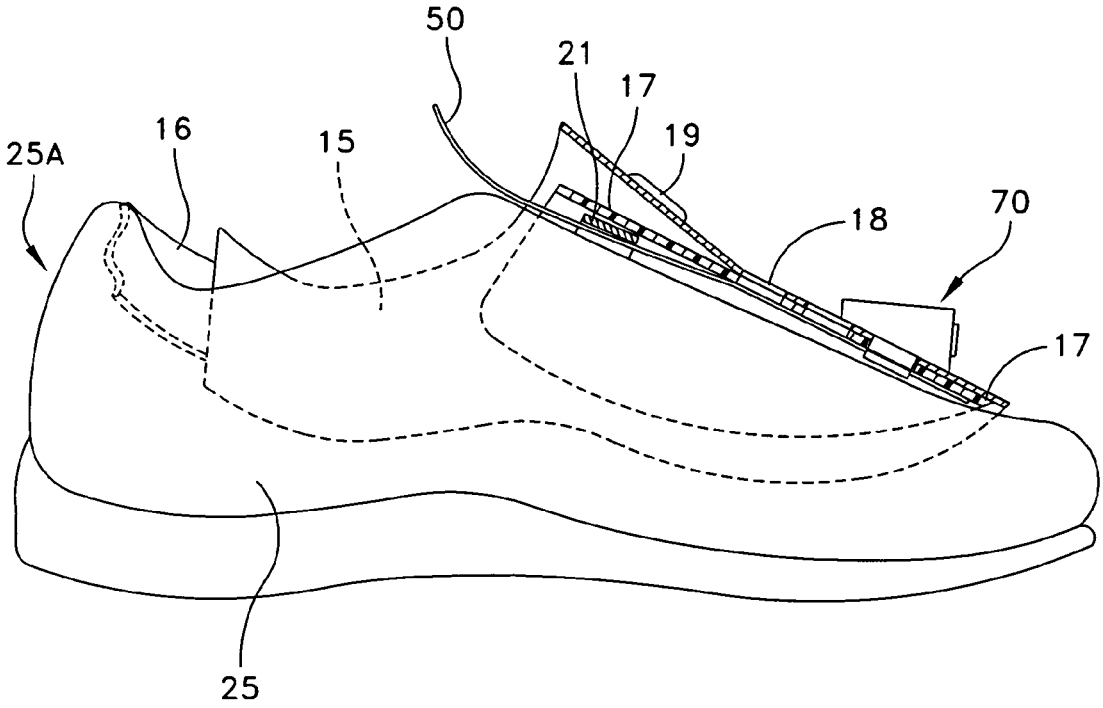
FIG. 6A illustrates a cross-sectional view of the shoe light attachment of FIG. 1, attached to a shoe, with light means attached.

Referring to FIGS. 6, 6A and 7 the mounting panel 17 includes an elongate ridged member 50 having a first end 50A attached to the mounting panel bottom surface 17A and a second end 50B detached from mounting panel bottom surface 17A and capable of flexing somewhat stiffly outwardly so as to facilitate the second end being positionable and secured under a shoe 20 laces 21 (see FIG. 6A).

Figure 4:
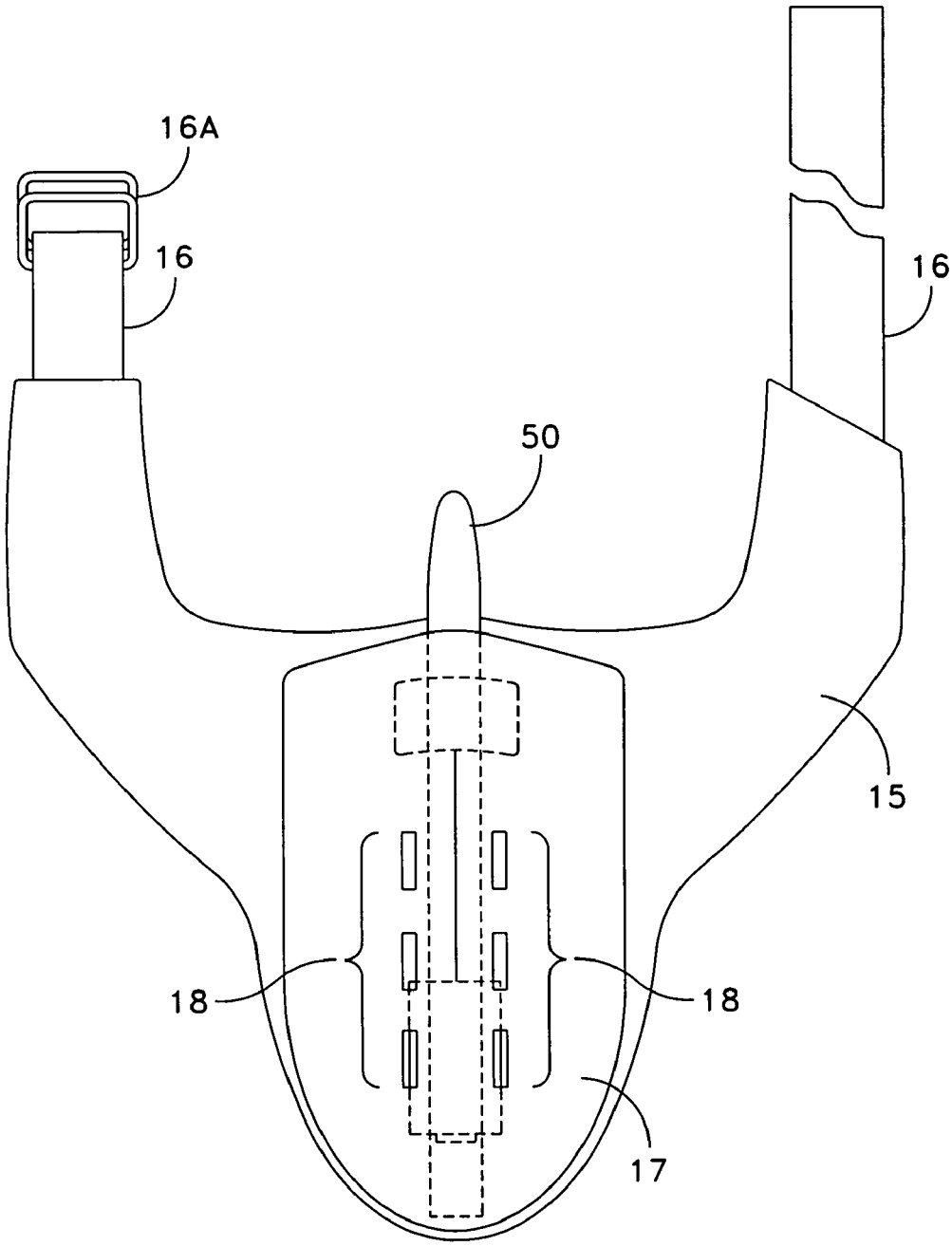
FIG. 4 illustrates a bottom view of the shoe light attachment of FIG. 1.
Figure 5:
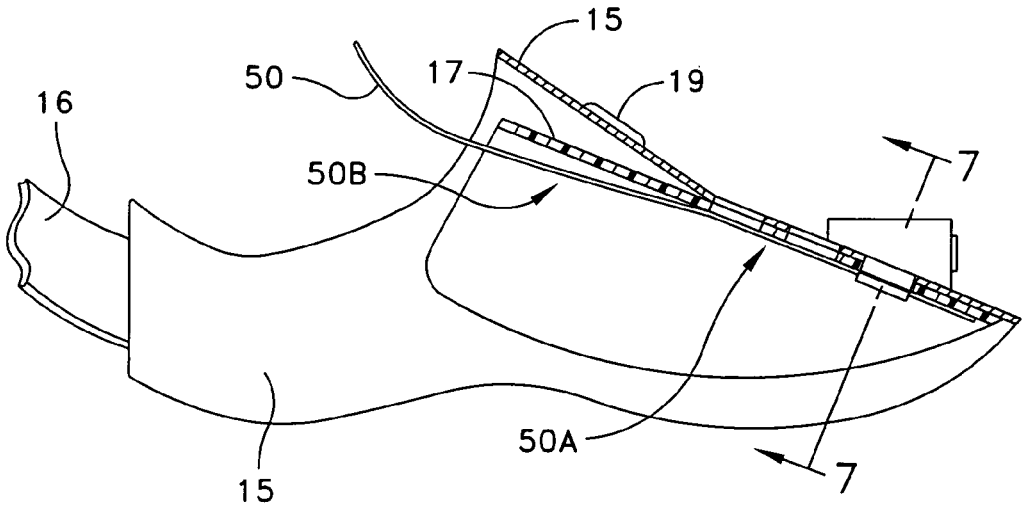
FIG. 5 illustrates a cross-sectional view of the shoe light attachment of FIG. 2 with light means attached.

In the preferred embodiment, elongate-ridged member 50 first end 50A extends along and is attached to the center of mounting panel 17 bottom surface 17A between receiving sockets 18 with a portion of second end 50B extending beyond mounting panel 17 (see FIGS. 4,5).

Referring to FIGS. 1, 7, 8, and 9 light assembly 70 includes a housing 70A that allows for light means 70B to be offset upwardly to counteract the downward sloped receiving sockets 18. Housing 70A further includes a battery power source for operation of light means 70B. This upward offset would be enough such that the light beam emanating from light means 70B would project above ground level. Light assembly 70 further includes stiffly resilient engagement extensions 70C having end protuberance 70D. Referring to FIG. 8, receiving sockets 18 are spaced such that end protuberance 70D must be biased inward to slideably engage receiving sockets 18.

This slideable engagement continues up to a point when biased protuberance 70D engages the bottom surface 17A of mounting panel 17 as illustrated in FIG. 7, and engagement extensions 70C have flexed back to their normal positions. In the preferred embodiment, bottom surface 70E of light assembly 70, would rest on top surface 15A of harness 15 when light assembly 70 is fully engaged and mounted into receiving sockets 18, as illustrated in FIG. 7. Referring to FIG. 2, mounting panel 17 further includes switch means 19 connected to light means 70B. Switch means 19 is any switch known in the art which will have sufficient surface area to allow the user to use his other foot to activate the switch and turn light means 70B on and off. Switch means 19 is connected to conductor 19A hidden under harness 15.

Conductor 19A connects to light means 70B via connection means that allow for switch means 19 to be connected to light means 70B when light assembly 70 is inserted in any of the plurality of receiving sockets 18. This connection means may be any means known in the art including a plurality of separate connectors or conductive strips interfacing switch means 19 to light means 70B via conductor 19A. The conductive strips or connectors may be located within or about the receiving sockets providing a connection to light means 70B for switching light means 70B battery source on and off via switch means 19. Light assembly 70B may also include its own switch integrated into housing 70A for turning light means 70B on and off.

It should be understood that the following is a detailed description of the invention and that numerous changes to the disclosed embodiments can be made in accordance with the disclosure herein without departing from the spirit or scope of the invention. Rather, the scope of the invention is to be determined only by the appended claims and their equivalents.

We claim:

1. A shoe light attachment for placement on a shoe having an upper portion and a heel portion, the upper portion including laces thereon, comprising:

a harness adapted to be secured to a shoes upper portion, wherein said harness includes a mounting panel integral to said harness, said mounting panel further including a plurality of receiving sockets therethrough said mounting panel and said harness; and a light means for projecting an illuminating light positionable within said plurality of receiving sockets.

2. A shoe light attachment as in claim 1, wherein said harness includes attachment means for securing said harness to said laces.

3. A shoe light attachment as in claim 2, wherein said attachment means of said harness comprises an elongate ridged member attached thereto, said elongate ridged member including a first end and a second end, said first end attached to a portion of the bottom surface of said harness said second end being detached from said harness bottom surface, said second end for engagement under a shoes laces.

4. A shoe light attachment as in claim 3, wherein said second end of said elongate ridged member is stiffly flexible.

5. A shoe light attachment as in claim 1, wherein said mounting panel substantially covers said shoe lace portion of said shoe upper portion.

6. A shoe light attachment as in claim 1, wherein said light means is switchable.

7. A shoe light attachment as in claim 6, wherein said switchable light means further includes housing means, said housing means encasing said switchable light means for positioning said light means in a upward direction.

8. A shoe light attachment as in claim 7 wherein said housing means includes a battery power source for said light means.

9. A shoe light attachment as in claim 7, wherein said switchable light means further includes a switch, said switch mounted on said harness, said switch having sufficient surface area to allow the user to activate the switch with his/her foot, said switch activation alternating said switchable light means to an on or off state, said switch connected to a conductor, said conductor attached to a connection means for connecting said switch to said light means.

10. A shoe light attachment as in claim 7, wherein said housing means further includes stiffly resilient engagement extensions.

11. A shoe light attachment as in claim 10, wherein said engagement extensions further comprise a protuberance at said engagement extension ends, said stiffly resilient engagement extensions biased inward for slideably engaging said plurality of receiving sockets up to a point when biased protuberance engages the bottom surface of said mounting panel, said engagement extensions then flexing back to their normal positions, and securing said light means.

12. A shoe light attachment as in claim 6, wherein said switchable light means further includes housing means, said housing means encasing said switchable light means for positioning said light means in a upward direction.

13. A shoe light attachment as in claim 12, wherein said housing means includes a battery power source for said light means.

14. A shoe light attachment as in claim 12, wherein said switchable light means further includes a switch, said switch mounted on said harness, said switch having sufficient surface area to allow the user to activate the switch with his/her foot, said switch activation alternating said switchable light means to an on or off state, said switch connected to a conductor, said conductor attached to a connection means for connecting said switch to said light means.

15. A shoe light attachment as in claim 1, wherein said receiving sockets are aligned along the center of said mounting panel.

16. A shoe light attachment as in claim 1, wherein said mounting panel further includes an elongate ridged member attached thereto, said elongate ridged member including a first end and a second end, said first end attached to a portion of said bottom surface of said mounting panel between said receiving sockets said second end being detached from said mounting panel bottom surface, said second end for engagement under a shoes laces.

17. A shoe light attachment as in claim 1 wherein said harness further includes heel attachment means for securing said harness around said heel portion of said shoe.

18. A shoe light attachment for placement on a shoe having an upper portion and a heel portion, the upper portion including laces thereon, comprising:

a light means for projecting an illuminating light positionable at a plurality of locations along a shoes upper portion;

a harness adapted to be secured to said shoes upper portion, wherein said harness includes attachment means for securing said harness to said laces, wherein said harness further includes a mounting panel integral to said harness, wherein said mounting panel further includes a plurality of receiving sockets therethrough said mounting panel and said harness, said light means secured and positionable within said plurality of receiving sockets, wherein said attachment means of said harness comprises an elongate ridged member attached thereto, said elongate ridged member including a first end and a second end, said first end attached to a portion of the bottom surface of said harness said second end being detached from said harness bottom surface, said second end for engagement under a shoes laces; and heel attachment means for securing said harness around said heel portion of said shoe.

* * * * *